US009272313B2

(12) United States Patent
White

(10) Patent No.: US 9,272,313 B2
(45) **Date of Patent: *Mar. 1, 2016**

(54) CRYOGENIC CLEANING METHODS FOR RECLAIMING AND REPROCESSING OILFIELD TOOLS

(71) Applicant: TRC Services, Inc., The Woodlands, TX (US)

(72) Inventor: Lonnie Dale White, Midland, TX (US)

(73) Assignee: TRC Services, Inc., The Woodlands, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/528,821

(22) Filed: Oct. 30, 2014

(65) Prior Publication Data

US 2015/0047673 A1 Feb. 19, 2015

Related U.S. Application Data

(63) Continuation-in-part of application No. 14/074,381, filed on Nov. 7, 2013, now Pat. No. 8,900,372, and a continuation-in-part of application No. 13/669,146, filed on Nov. 5, 2012, now Pat. No. 8,920,570.

(60) Provisional application No. 61/723,488, filed on Nov. 7, 2012.

(51) Int. Cl.

| | |
|---|---|
| ***B08B 7/02*** | (2006.01) |
| ***B08B 7/00*** | (2006.01) |
| ***B24C 1/00*** | (2006.01) |
| ***B24C 1/08*** | (2006.01) |
| *E21B 37/00* | (2006.01) |
| *B08B 9/08* | (2006.01) |
| *B08B 9/02* | (2006.01) |
| *B08B 9/053* | (2006.01) |
| *B08B 9/00* | (2006.01) |
| *B08B 9/027* | (2006.01) |
| *B24C 3/32* | (2006.01) |
| *B08B 5/02* | (2006.01) |
| *B08B 5/04* | (2006.01) |
| *B08B 3/02* | (2006.01) |

(52) U.S. Cl.

CPC ..... *B08B 7/0092* (2013.01); *B08B 7/0064* (2013.01); *B24C 1/003* (2013.01); *B24C 1/086* (2013.01); *B08B 3/02* (2013.01); *B08B 5/02* (2013.01); *B08B 5/04* (2013.01); *B08B 7/0007* (2013.01); *B08B 9/00* (2013.01); *B08B 9/02* (2013.01); *B08B 9/021* (2013.01); *B08B 9/027* (2013.01); *B08B 9/053* (2013.01); *B08B 9/08* (2013.01); *B08B 9/0804* (2013.01); *B24C 3/325* (2013.01); *E21B 37/00* (2013.01)

(58) Field of Classification Search

CPC ..... E21B 37/00; B08B 9/00; B08B 9/027; B08B 9/021; B08B 9/02; B08B 9/053; B08B 9/08; B08B 9/0804; B08B 3/263; B08B 5/02; B08B 5/04; B24C 1/003; B24C 3/325

See application file for complete search history.

(56) References Cited

U.S. PATENT DOCUMENTS 4,491,484 A * 1/1985 Williams ..... 134/4
4,806,171 A * 2/1989 Whitlock et al. ..... 134/7

(Continued)

*Primary Examiner* — Bibi Carrillo
(74) *Attorney, Agent, or Firm* — Ramey & Schwaller, LLP

(57) ABSTRACT

The disclosure relates to the cleaning of oilfield tools made of metal, particularly to the method of reclamation oilfield tools, already used in the mechanical deep-pumping extraction of oil, as well as to the product made with the help of the mentioned method. The method of remanufacturing of standard length rods includes cleaning the rod with at least one cryogen to eliminate environmental contamination and to assist in workplace safety.

19 Claims, 4 Drawing Sheets

(56) References Cited

U.S. PATENT DOCUMENTS

| | | | | |
|---|---|---|---|---|
| 5,018,667 | A | 5/1991 | Lloyd | |
| 5,660,580 | A | 8/1997 | Lehnig | |
| 6,315,639 | B1 * | 11/2001 | Kipp | 451/38 |
| 7,397,238 | B2 | 7/2008 | Walters et al. | |
| 8,187,057 | B2 | 5/2012 | Broecker | |
| 2014/0053404 | A1 * | 2/2014 | Johnson et al. | 29/888.021 |
| 2014/0124001 | A1 * | 5/2014 | White | 134/7 |
| 2015/0047673 | A1 * | 2/2015 | White | 134/7 |

* cited by examiner

CRYOGENIC CLEANING METHODS FOR RECLAIMING AND REPROCESSING OILFIELD TOOLS

CROSS REFERENCE TO RELATED APPLICATIONS

This application is a continuation in part of U.S. patent application Ser. No. 14/074,381, filed on Nov. 7, 2013, which claims priority to U.S. Provisional Application 61/723,488, filed on Nov. 7, 2012. The application also claims priority to U.S. patent application Ser. No. 13/669,146, filed on Nov. 5, 2012. The entire disclosure of these applications is incorporated herein by reference.

FIELD

The embodiments of the invention disclosed herein relate to the cleaning process in the recovery or remanufacturing of oilfield equipment. More specifically, the embodiments of the invention disclosed herein relate to the cryogenic cleaning of oilfield tools such as sucker rods, couplings for sucker rods, and sucker rod pumps and pony rods used in wells in oil fields.

BACKGROUND

Downhole operations involving the pumping of oil are used to suck or otherwise lift fluids such as oil from subsurface formations to the surface after the initial pressure from the subsurface formations has subsided.

In the oilfield industry, many wells use a downhole reciprocating type production pump to lift oil from a borehole to the surface. Rods extend from the surface to the extraction area to enable a pump jack located at the surface to cause reciprocal movement of the rod and bring oil to the surface. These rods are known as sucker rods or pump rods and are typically between 25 and 40 feet in length, and threaded at both ends. These rods join together the surface and downhole components of a reciprocating piston pump installed in an oil well. These rods are typically between 25 and 30 feet (7 to 9 meters) in length, and threaded at both ends.

For various reasons, such as wear and tear, and the accumulation of contaminants in a downhole environment, the sucker rods, their couplings, and downhole rod pumps must be removed and replaced from time to time. Typically, upon removal, these oilfield tools are subjected to various forms of inspection, reconditioning and or remanufacturing. In this manner, a used oilfield tool or its components can be safely returned to service.

In general, the main process of reclaiming or reconditioning a used oilfield tool utilized in oil pump wells comprises obtaining the tool, cleaning the rod to remove contaminates from use in oil extraction, and performing an inspection of the tool to determine if the tool should be reconditioned or discarded. In the case of sucker rods, the rods are categorized into steel class, heated until plastic deformation, shaped, cooled and cut to the desired length.

When these components are removed from the well and reclaimed, reconditioned or both, the general method includes cleaning the tool to remove contaminates from use in oil extraction, performing a visual inspection of the tool and gauging the tool to determine if the rod should be reconditioned.

Typical contaminants found on downhole rod pumps include scale, paraffin, and asphaltenes. When the used oilfield tools are removed from the wellbore, they undergo a cleaning process. Typically, the cleaning process entails washing, pressure washing or dipping the oilfield tool in kerosene, or other organic compounds such as mineral spirits, naptha and the likes to dissolve the contaminants on the equipment. However, the use of these chemicals, especially when heated, can release volatile organic compounds. This is problematic not only for the environment but for workers at facilities where the contaminants are removed.

After cleaning, the oilfield tools are visually inspected for defects as well as subjected to non-visual inspection techniques to ensure that there are no stress fractures and the like that could otherwise not be seen.

It would therefore be advantageous to reduce the contamination to the environment and to the cleaning facility by the utilization of non-toxic cleaners and cleaners which do not result in solubility of contaminates from rods such as sucker rods. Cryogens such as dry ice and non-toxic gases in low temperature liquid form could therefore be used to eliminate the problem of volatile organic compounds and reduce cleanup costs associated with using these organic solvents.

Because there is no secondary waste stream, non-toxic inorganic cryogenic liquids are advantageous from a cleaning standpoint. Typically, the only waste to clean up afterward is the grime, paraffin, scale, asphaltenes or whatever other contaminants were removed. Likewise, in the process of putting the tools back in service, total job time is greatly reduced due to the fact there is very little post-blast cleanup required.

Cryogenic applications to the surface of sucker rods can produce an expansion factor upon making contact with the rods themselves. This is because the cryogens liquids or solids can change and expand to a gas.

In the case of a propelled cryogen or cryogenic compound, depending on the type of cryogen being used, and the air pressure and nozzle selected, the cryogen can travel at speeds between 600 and 800 feet per second. Assuming that the cryogen is able to initially penetrate the contaminant, this expansion occurs at the underlying substrate, thus lifting the contaminant off. Alternatively or additively, the cryogenic liquid can produce a thermal shock effect, as the particles are at sub-zero temperatures.

Cryogens impacting a sucker rod or other pump rod surface with contaminants typically removes contaminates in one of three ways: via kinetic energy, via thermal shock or via a thermal-kinetic effect. Kinetic energy transfers the energy of the accelerated cryogen (or cryogenic compound) as it hits the surface of the rod to be cleaned during the blasting process; this is akin to a pressure washing effect. However, in some applications, a low pressure cryogenic liquid is instead used. Likewise, thermal shock occurs when certain cryogens strike a much warmer contaminated surface during the blasting process. The cold temperature of the cryogen causes the bond between the surface being cleaned and the contaminants to weaken. This effect aids in the release of the contaminant when struck by the liquid during the blasting process. The thermal-kinetic effect combines the impact of evaporation and the rapid heat transfer discussed above. When the pressurized cryogenic liquid hits the contaminated surface, the vapor expands fast enough that micro-explosions occur which take off the contaminants from the rod.

In other situations, a cryogen or cryogenic compound can be used as a bath. As explained above, used oilfield tools are often bathed in organic solvents such as heated kerosene baths. Instead, it would be advantageous to dip or bathe the contaminated oilfield tools in cryogenic liquids such as liquid nitrogen, cryogenic solid pellets such as dry ice, or cryogenic slurries comprising a gas in cryogenic liquid form mixed together with dry ice pellets. This last method, combined with agitation of the slurry or the oilfield tool would both allow thermal shock and a kinetic effect of bombardment with dry ice. The effect could also be achieved by adding other solid particles into the cryogenic liquid.

In the embodiments herein discussed, the non-toxic inorganic cryogenic liquids are gasses which liquefy below the freezing point of water. Preferable examples of non-toxic liquids with an evaporation point below the freezing point of water which can be utilized in the present invention include: liquid nitrogen, liquid oxygen, liquid hydrogen, liquid helium, liquid neon, liquid argon, liquid krypton, liquid xenon, sulfur hexafluoride, and the like.

SUMMARY OF THE INVENTION

Certain embodiments of the disclosure herein pertain to a method of removing contaminates from used oilfield tools. In this embodiment, the method comprises the steps of 1) obtaining a used oilfield tool which has been contaminated with scale, asphaltenes or a combination thereof; 2) bombarding said contaminates with a substance comprising at least one cryogen, wherein the at least one cryogen is in solid or liquid form, wherein any cryogen used is a gas at 32° F. at atmospheric pressure, and wherein the substance is propelled toward the used oilfield tool from at least one nozzle; and 3) hardening the oilfield tool and subjecting the oilfield tool to non-visual inspection.

Further, in these embodiments, the scale asphaltenes or a combination thereof are removed from the used oilfield tool by one or more of the following effects: 1) kinetic energy from the non-toxic solid particles, wherein said kinetic energy accelerates the non-toxic solid particles such that said scale, asphaltenes, paraffin or a combination thereof are blasted away from the used sucker rod; 2) thermal shock that weakens the scale, asphaltenes or a combination thereof by dropping the temperature of the contaminants; and 3) thermal-kinetic energy that causes vapor to form from sublimation of the non-toxic solid particles upon impact with said scale, asphaltenes or a combination thereof, wherein the vapor expands and causes micro explosions which remove the scale, asphaltenes or a combination thereof.

Still further, in the embodiments of the invention, after cleaning with a cryogen or a combination of cryogens as discussed above, the tool is subjected to hardening to prevent or alleviate the formation of stress fractures and the like. Still further, the oilfield tools are subjected to non-visual inspection.

In further embodiments of the aforementioned disclosure, the cryogen is one or more of the following: liquid nitrogen, liquid oxygen, liquid hydrogen, liquid helium, liquid neon, liquid argon, liquid krypton liquid xenon, liquid sulfur hexafluoride, solid carbon dioxide, or a combination thereof. In still further embodiments, the cryogen further comprises non-cryogenic particles.

In embodiments of the aforementioned disclosure concerning hardening, the hardening comprises hammering, shot blasting, shot peening, heat treating, heat treating and then quenching, tempering, induction hardening, case hardening, carburizing, nitriding, boriding, titanium carbon diffusion, or a combination thereof.

Specific embodiments of the disclosure pertain to a downhole rod pump as the oilfield tool. In certain further embodiments, the downhole rod pump is disassembled prior to cleaning and then reassembled after hardening. In typical embodiments, prior to assembly of the downhole rod pump, the pump is subjected to inner diameter measurement, outer diameter measurement, or a combination thereof to determine if the pump is still within specified ranges.

Other embodiments of the disclosure pertain to a sucker rod as the oilfield tool. In certain further embodiments, the sucker rod is disassembled from the sucker rod couplings prior to cleaning. Sometime after non-visual inspection the sucker rod is reassembled for use. Regarding the sucker rod coupling, the methods further comprise measuring the inner diameter of the rod coupling to ensure that it is within normal tolerances.

In embodiments of the disclosure pertaining to non-visual inspection, the non-visual inspection is magnetic particle inspection, magnetic flux leakage inspection, ultrasonic inspection, eddy current inspection, acoustic emission inspection, radiographic inspection, acoustic emission, infrared thermography, phased array ultrasonic testing, or a combination thereof.

Additional embodiments of the disclosure pertain to washing an oilfield tool contaminated with scale, asphaltenes, paraffin, or a combination thereof wherein the method does not release volatile organic compounds into the air as is the case with traditional cleaning such as kerosene, mineral spirits and the like. In this method, upon obtaining the oilfield tool contaminated with scale, asphaltenes, paraffin or a combination thereof, the tool is optionally disassembled and dipped or bathed in a cryogenic solution. Further, the contaminants are removed by thermal shock that weakens the scale, asphaltenes or a combination thereof by dropping the temperature of these contaminants. Upon cleaning, the oilfield tools are removed from the cryogenic solution and subjected to hardening to prevent growth of cracks on an external surface of the oilfield tool.

In cases wherein the cryogenic solution, which includes a gas in cryogenic liquid form as discussed above and wherein it also includes solid carbon dioxide, which is known as dry ice, or a non-cryogenic solid, the scale, asphaltenes or a combination thereof are removed by thermal shock, abrasion, or a combination thereof. In certain cases, due to the extreme cold nature of a cryogenic liquid, water ice can be used in lieu of dry ice. In some instances, the solid impacts the oilfield tool by agitation of the bath or the oilfield tool within the bath.

After bathing or dipping the oilfield tool to clean it, in this embodiment, the oilfield tool is subjected to hardening and non-visual inspection as described above.

DESCRIPTION

Definitions

Figure 1:
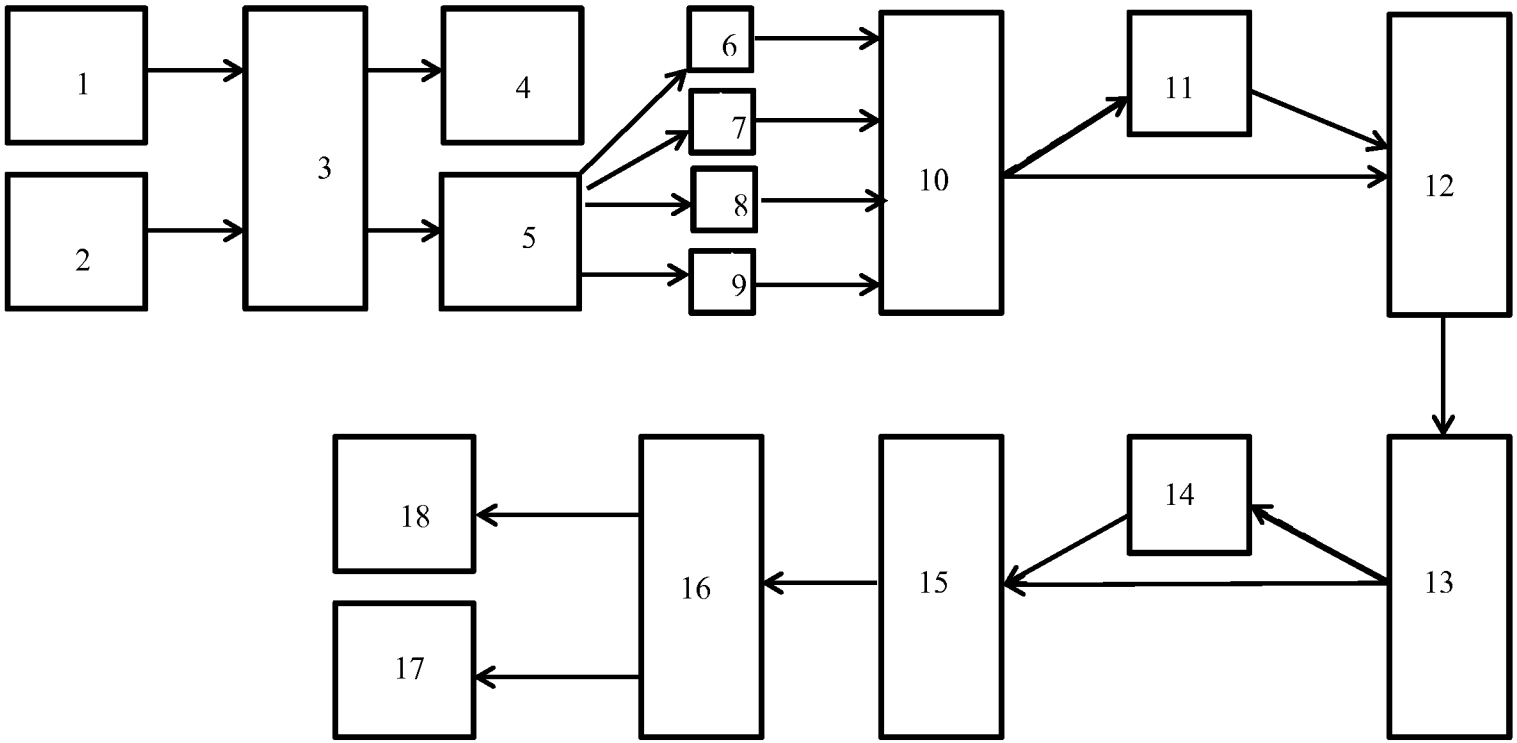
FIG. 1 is a flow chart of one embodiment of a method of cryogenically cleaning and reconditioning oilfield tools.
Figure 2:
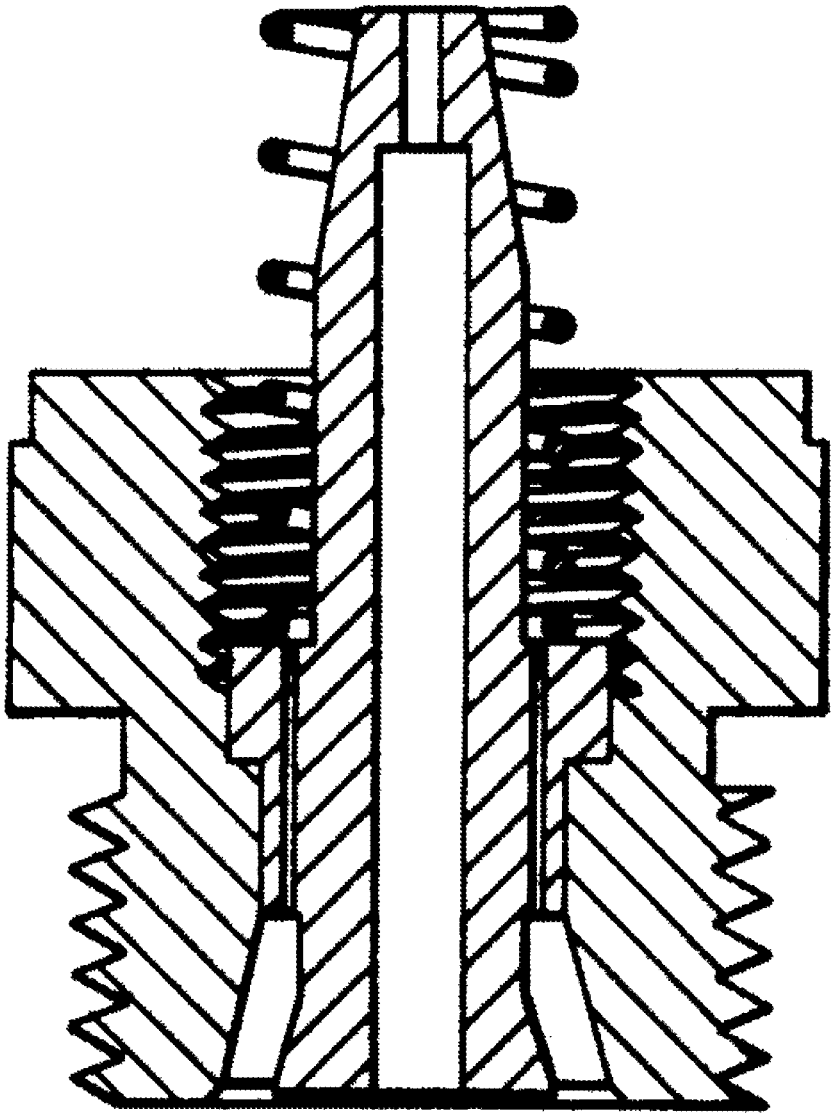
FIG. 2 is a prior art illustration of a phase change injection nozzle that causes a phase change of carbon dioxide from a liquid state to a solid state by flowing pressurized liquid carbon dioxide through an orifice.
Figure 3:
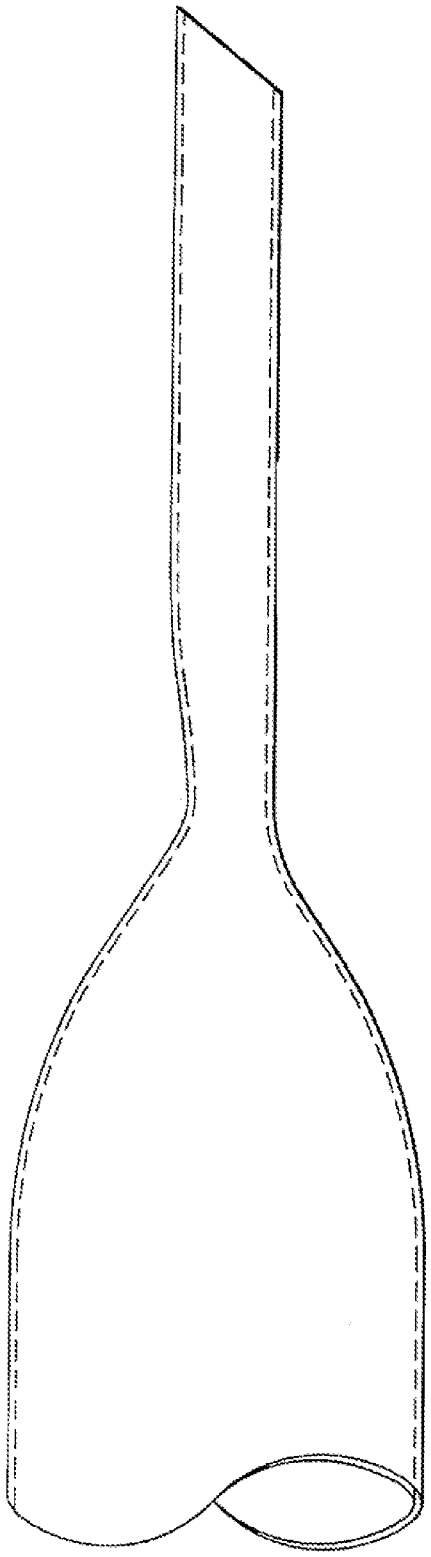
FIG. 3 is a prior art illustration of a supersonic nozzle used in particle blasting dry ice.
Figure 4:
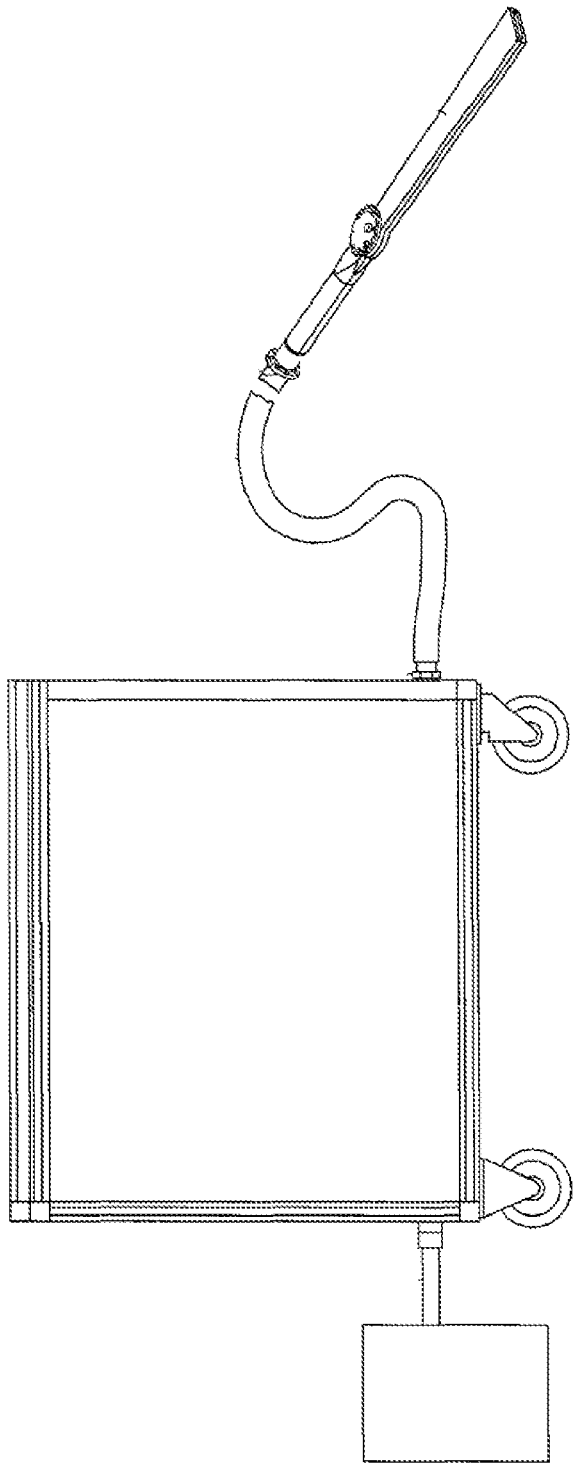
FIG. 4 is a prior art illustration of an isometric view of a media blasting apparatus with an attached converging diverging nozzle device for ejecting compressed air and media particles therefrom, the attached nozzle device further having a media size changer.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings making apparent to those skilled in the art how the several forms of the invention are embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3rd Edition.

As used herein, the term "sorting" means to arrange according to class, kind, and/or size; to classify.

As used herein, the term "rod" includes hollow or solid rods, continuous rods or joints, and includes welded, flanged, screwed, and other rod goods. In particular, sucker rod joints are one type of rod which benefits from the methods described herein, but the disclosure is not so limited.

As used herein, the term "used oilfield tool" means an oilfield tool that has been in actual service for a purpose, such as transporting fluids, connecting a downhole pump to a surface driver, and the like, whether on the surface, downhole, underwater, on-shore, or off-shore.

As used herein, the phrase "performing non-visual, non-destructive inspection" means a technique which does not impair the oilfield tools from performing their intended function or use, and does not involve a human visual test.

The term "rod coupling" refers to the end of a pump rod or sucker rod that is removable from the rod itself and allows rods to be attached to the downhole rod pump, machinery on the surface, or other rods.

The term "downhole rod pump" refers to a generally non-powered pump typically attached to the bottom or proximal end of the pump rod length and is used to pull oil from below upward so that it can be extracted.

The term "cryogen" refers to an element or compound that is in either a solid or liquid form at some point below 32° F. at atmospheric pressure and is a gas above 32° F. at atmospheric pressure. It is to be understood that the transformation from liquid to gas or solid to gas can occur below 32° F. at atmospheric pressure depending on the evaporation temperature or freezing temperature of the cryogen.

Embodiments

In the present disclosure, embodiments described herein pertain to a method of removing contaminates from a used oilfield tool. In these embodiments, the method is often in a stepwise fashion. Typically, the first step is obtaining a used oilfield tool, such as a sucker rod or a downhole rod pump. In the case of a sucker rod, the sucker rod has end couplings in order to create a chain of sucker rods and to attach the downhole rod pump. In many embodiments, these can be considered separate oilfield tools as they are disassembled from the sucker rod conglomerate comprising both components. After disassembly, they are typically cleaned, then checked for defects. Likewise, the downhole rod pump can be disassembled and checked for defects. This can occur either before or after the initial cleaning. The downhole rod pump can also be subjected to hardening. In some cases the hardening is for some or all of the subcomponents of the downhole rod pump when disassembled. In other cases it is for the assembled tool.

Still further in the aforementioned embodiment, the cleaning process is directed to oilfield tools which are contaminated with scale, asphaltenes, or a combination thereof.

Scale is a deposit or coating formed on the surface of metal, rock, or other material. Scale is caused by a precipitation due to a chemical reaction with the surface, precipitation caused by chemical reactions, a change in pressure or temperature, or a change in the composition of a solution. The term is also applied to a corrosion product. Typical scales are calcium carbonate, calcium sulfate, barium sulfate, strontium sulfate, iron sulfide, iron oxides, iron carbonate, the various silicates and phosphates and oxides, or any of a number of compounds insoluble or slightly soluble in water.

Asphaltenes are molecular substances that are found in crude oil, along with resins, aromatic hydrocarbons, and saturates (i.e. saturated hydrocarbons such as alkanes). Asphaltenes consist primarily of carbon, hydrogen, nitrogen, oxygen, and sulfur, as well as trace amounts of vanadium and nickel.

After removing the oilfield tools from downhole and moving them to the area where they are to be cleaned and processed, the tools are typically laid on a rack that feeds into a transfer conveyor. The visibly damaged tools are typically removed immediately. The remaining tools are typically feed onto the conveyor which typically conveys the tool into an area designed to accommodate the cryogen cleaning process. However, it is to be understood that other methods of moving the tools prior to cleaning exist and can be used with the embodiments disclosed herein.

In the case of blasting the tools, the tools typically travel into the semi-enclosed cabinet with cryogen nozzles aligned to maximize the cleaning of the outer surface of the tools. The tools can be conveyed through the cleaning cabinet in single tool at a time or can be multiple tools at a time. As the tools travel through the cleaning cabinet, the cryogen is propelled from the blasting machine through a hose to the rotating blast nozzles which typically direct the pattern to adequately clean the surface of the rods, the bare pin threads, and the coupling (if still attached). As the cryogen enters into the crevices, cracks, etc. of the debris and residue, the cryogen expands typically to between 100 and 1000 times its original size as it expands into a gas, thus removing the debris in the process.

As indicated above, in order to clean the oilfield tools, the tools are bombarded with at least one cryogen. In certain embodiments, the cryogen is actually a cryogenic compound with more than one cryogenic liquid or solid. For purposes herein, the cryogen used is a gas at 32° F. at atmospheric pressure. At some point below this temperature and pressure, the substance becomes a liquid and then a solid, as is the case with nitrogen, or a solid as is the case with carbon dioxide.

The cryogens used in most embodiments are not volatile organic compounds and have either no toxicity as in the case of noble gasses, or generally low toxicity as in the case of dry ice. For example, fluorine is highly reactive and highly toxic and is therefore undesirable. On the other hand, the liquid form of nitrogen is generally inert and non-toxic. The cryogens, in addition to the noble gasses in liquid form, can include liquid hydrogen (which is explosive as a gas but non-toxic), liquid oxygen and liquid sulfur hexafluoride. Other gasses which could conceivably be used include gasses such as liquid methane, liquid ethane, liquid propane, and liquid butane. While all are flammable in gas form, they are generally regarded as non-toxic.

In embodiments concerning dry ice as a cleaning material, the material is shaped in amorphous form. In other embodiments, the dry ice is shaped in roughly a cylindrical form. In other embodiments, the dry ice is shaped in an oval form. In still further embodiments, the dry ice is shaped in a spherical form.

In the case of dry ice, dry ice pellets can either be manufactured with pelletizing equipment on site or can be brought in from an outside source. Pellets that are brought in from an outside source are typically stored in an insulated container until ready for use. Pellets that are manufactured on site typically require that a supply of liquid carbon dioxide is available, usually in a storage tank. The liquid carbon dioxide is piped into the pelletizer which typically changes the liquid carbon dioxide into a solid ice pellet.

In implementation, the pelletizer is directly connected to a dry ice blaster. Alternatively, it can be a stand-alone unit. However, with either system, the ice pellets are placed into the dry ice blaster. In implementation, the dry ice blaster is connected to an air compressor source that typically produces a pressure of 100 psi at 80 cfm to provide the energy to force the ice pellets onto the surface of the sucker rod. The dry ice blaster keeps the pellets contained until they are fed into the cleaning source hose that is attached to a nozzle to provide the desired pattern and coverage of the blast stream to effectively remove the unwanted debris from the surface of the oilfield tool. The debris that is removed from the surface of the oilfield tools is captured into an enclosed cabinet or tray that will be disposed of according to regulatory requirements.

The cryogenic liquid can either be manufactured with equipment on site or can be brought in from an outside source. For example, when liquid nitrogen is used, the liquid can be brought in from an outside source and stored in an insulated container until ready for use. Alternatively, the non-toxic cryogenic liquid is manufactured on site and typically entails the use of equipment that is capable of extracting a supply of cryogenic liquid from the atmosphere.

Typically, the cryogenic liquid is piped into the pressurized machine which will force the cryogenic liquid onto the surface to be cleaned. A specialized nozzle to direct the pattern of the cryogenic liquid is sometimes necessary to ensure coverage of the surface and with enough pressure to remove the residue and debris.

The cryogenic liquid blasting equipment in certain embodiments is directly connected to the cryogenic liquid extraction machine, or it can be a stand-alone unit. The cryogenic liquid blaster can be connected to an air compressor source that produces a range of pressures, typically from 6,000 to 55,000 psi to provide the energy to force the cryogenic liquid onto the surface of the sucker rod. The cryogenic liquid blaster is a piece of equipment that keeps the cryogenic liquid at a necessary temperature to remain in liquid form until it is fed into the hose that is attached to the rotating blast nozzle to provide the desired pattern and coverage of the blast stream to effectively remove the unwanted debris from the surface of the sucker rods.

In embodiments regarding the use of a nozzle, the nozzle spraying the tool is often capable of moving up and down the tool from end to end to spray cleaning agent on the tool. It is further contemplated that the nozzle spraying the tool is capable of moving in substantially a 360 degree rotation around the rod in order to spray the rod with a cleaning agent evenly. Some nozzles are handheld, and others are mounted such that the nozzle moves relative to the tool or vice versa.

In still further embodiments regarding the nozzle, the cleaning apparatus has multiple nozzles. In still further embodiments, the nozzles are within the same axis which is parallel to the rod. In other embodiments, the nozzles are in an axis which is perpendicular to the rod axis and surrounds or substantially surrounds the rod. In certain further embodiments, the nozzles are diagonal with respect to the rod axis and either surround or substantially surround the rod. In certain further embodiments, the nozzles are spaced randomly and in many cases are substantially perpendicular to the rod axis, or in the alternative can surround or at least partially surround the rod.

In embodiments concerning the nozzle shape, the nozzle can expand from a cleaning source such that the diameter or area of a cleaning source hose is less than the diameter of the terminal end of the nozzle facing the rod.

In other embodiments concerning nozzle shape, the nozzle can contract from a cleaning source such that the diameter or area of a cleaning source hose, through which the cleaning material flows before exiting into the nozzle, is greater than the diameter of the of the terminal end of the nozzle facing the rod. Still further, in other embodiments, the nozzle is the same size in diameter as the cleaning source hose.

In still other embodiments concerning nozzle shape, the terminal end of the nozzle facing the rod can have multiple bores for the cleaning material to exit. In other embodiments, the nozzle shape is such that there is an annular ring around the nozzle facing in an inward direction to focus the cleaning material to a certain point on the rod. Likewise, in other embodiments, the nozzle shape is such that there is an annular ring around the nozzle facing in an outward direction to spread the cleaning material in an efficient manner to a large area of the rod to be cleaned.

In embodiments concerning the application of the cryogen or other cleaning material to the tool through the use of a nozzle or nozzles, the cleaning material can be pressurized such that it contacts the tool at a desired speed. The pressure can be any pressure contemplated that propels the cleaning material to the tool. In certain embodiments, the pressure is 10 psi, 20, psi, 30 psi, 40 psi, 50, psi, 60 psi, 70 psi, 80 psi, 90 psi, 100, 200, 300, 400, 500, 600, 700, 800, 900, 1000 or more psi.

Nozzles for use in dry ice blasting are known in the art. Such nozzles can be found in U.S. Pat. Nos. 5,018,667; 5,660,580 and 8,187,057; each of which are specifically incorporated by reference in their entirety.

In addition to the cryogen, solids which are not considered cryogens by the definitions herein can be used to further aid in cleaning. Examples include water ice, any non-toxic solid such as a mineral compound like silicon dioxide, a metal such as steel, or a plastic. The solids can be of any shape and size such that they are able to effectively bombard the oilfield tools during the cleaning process. Typical sizes range from an eighth to a quarter of an inch in diameter for roughly spherical solids. The size of the dry ice used in the cleaning process can vary per application, rod type, rod durability, for example, aluminum versus steel, contaminant type, the time needed for sublimation to occur, and other factors.

In embodiments concerning the use of baths or dipping of the tools to remove contaminants, the cryogen is stored in a vat and the tool is lowered into the vat. In certain embodiments, the vat is shallow and the tools are lowered into it horizontally. In other embodiments, the vat is deep and tools are lowered into it in a vertical position. Still further, the cryogen can be poured over the tools instead of the tools being submerged.

The cryogens, depending on whether they are propelled or used as a bath, typically remove the contaminants in one of three ways: via kinetic energy, via thermal shock, or via a thermal-kinetic effect. Kinetic energy transfers the accelerated cryogen and possibly an additional solid as it hits the surface of the rod to be cleaned during the cryogen blasting process used with nozzles. In the case of dry ice, the dry ice pellets sublimate upon impact. Likewise, the liquid cryogen evaporates. Thermal shock occurs when the cryogen is exposed to a much warmer contaminated surface during either blasting or bathing. The cold temperature of the cryogen causes the bond between the surface being cleaned and the contaminants to weaken. The thermal-kinetic effect combines the impact of the cryogen and any other solid particles and the rapid heat transfer discussed above. In this instance, when the cryogen hits the contaminated surface, the vapor expands fast enough that micro-explosions occur which take off the contaminants from the tool.

In certain other embodiments concerning the bathing or dipping of an oilfield tool into a vat or bath, the vat or bath contains at least one cryogen in liquid form and a solid. For example, when dipping a sucker rod, the vat for dipping the sucker rod could contain liquid nitrogen and liquid sulfur hexafluoride. In such embodiments, the solid can also be a cryogen such as dry ice. As indicated above, the solid can be a non-cryogenic solid such as ceramic beads, steel beads, plastic beads, water ice, and the like. In such embodiments, the oilfield tool can be agitated such that the tool not only is subject to thermal shock due to the extreme cold, but also kinetic shock due to impacts of the solids against the contaminants on the oilfield tool. Regarding agitation, in some embodiments, the bath or vat can be agitated instead of the tool itself.

Regarding the oilfield tools which are not sucker rods, in certain embodiments the rod couplings are removed prior to cleaning. In this manner the couplings are often checked after cleaning to determine if the inner diameter of the coupling is still the proper size for fitting to the rod. This helps to ensure that the rod will not disassociate from the couplings while in downhole use. Likewise, the downhole rod pump is either cleaned as a whole by dipping into a vat comprising at least one cryogenic liquid, or it is disassembled into its component parts and then cleaned. Further, the individual components of the downhole rod pump are measured in some embodiments for determination of proper tolerances.

During the process of cleaning, contaminants will fall from the oilfield tools. The debris that is removed from the surface is often captured into a receptacle that is disposed of according to regulatory requirements. In certain embodiments, the contaminants will fall into a contaminate catch area. In other embodiments, the contaminants are removed such that vibration, impact, or movement results in the contaminants separating from the tool. Still further, in certain embodiments, freezing the contaminants causes expansion or contraction and results in disassociation of the contaminants from the tool.

In some embodiments, the recovery of the contaminants is such that they are not deposited at the cleaning site or released into the environment. In such instances, a tray or trough can be placed under the tool being cleaned. Other methods include the use of a vacuum. In the case wherein the tools are being dipped in a cryogen, the contaminants fall to the bottom or remain suspended in the cryogenic fluid.

After cleaning the oilfield tools, they are generally subjected to measurement to ensure that the tools are within proper tolerances for re-use. For sucker rods, this can include measurement of the outer diameter, the outer diameter where attachment to the coupling occurs, length of the rod, and the like. For rod couplings, the inner diameter of the bore where the rod coupling receives the end of the sucker rod is measured for inner diameter width. Likewise, in the case of downhole rod pumps, measurements can be taken to ensure that the pumps are within tolerances.

As indicated above, after cleaning the oilfield tools are subjected to hardening to prevent further corrosion and to alleviate and inhibit micro-cracks.

In embodiments of the disclosure regarding hardening of the tools, there are several different methods that can be employed. These methods include hammering, shot blasting, shot peening, heat treating, heat treating and then quenching, tempering, induction hardening, case hardening, carburizing, nitriding, boriding, diffusion, or a combination thereof.

Shot peening is a cold working process in which the surface is bombarded with small spherical media called shot. As each individual shot particle strikes the surface, it produces a slight rounded depression. Plastic flow and radial stretching of the surface metal occur at the instant of contact and the edges of the depression rise slightly above the original surface. Benefits obtained by shot peening are the result of the effect of the compressive stress and the cold working induced. Compressive stresses are beneficial in increasing resistance to fatigue failures, corrosion fatigue, stress corrosion cracking, and hydrogen assisted cracking. Shot peening is effective in reducing sucker rod fatigue failures caused by cyclic loading. Stress corrosion cracking cannot occur in an area of compressive stress. The compressive stresses induced by shot peening can effectively overcome the surface tensile stresses that cause stress corrosion. Shot peening has been shown to be effective in retarding the migration of hydrogen through metal. Shot peening improves the surface integrity of the sucker rod. As peening cold-works the rod surface, it blends small surface imperfections and effectively eliminates them as stress concentration points. Hammering is considered the manual version of shot peening.

Similar to shot peening are shot blasting and sand blasting. Abrasive blasting is the operation of forcibly propelling a stream of abrasive material against a surface under high pressure to smooth a rough surface, roughen a smooth surface, shape a surface, or remove surface contaminants. While these abrasive techniques are used more in a cleaning process, they are worth mentioning as a way to remove corrosion.

Heat treating is a group of industrial and metalworking processes used to alter the physical, and sometimes chemical, properties of a material. The most common application is metallurgical. Heat treatments are also used in the manufacture of many other materials, such as glass. Heat treatment involves the use of heating or chilling, normally to extreme temperatures, to achieve a desired result such as hardening or softening of a material. Heat treatment techniques include annealing, case hardening, precipitation strengthening, tempering, and quenching.

Induction hardening is a form of heat treatment in which a metal part is heated by induction heating and then quenched. The quenched metal undergoes a martensitic transformation, increasing the hardness and brittleness of the part. Induction hardening is used to selectively harden areas of a part or assembly without affecting the properties of the part as a whole.

Case hardening or surface hardening is the process of hardening the surface of a metal object while allowing the metal deeper underneath to remain soft, thus forming a thin layer of harder metal (called the "case") at the surface. For steel or iron with low carbon content, which has poor to no hardenability of its own, the case hardening process involves infusing additional carbon into the case.

Carburizing is a heat treatment process in which iron or steel absorbs carbon liberated when the metal is heated in the presence of a carbon bearing material, such as charcoal or carbon monoxide, with the intent of making the metal harder. Depending on the amount of time and temperature, the affected area can vary in carbon content. Longer carburizing times and higher temperatures typically increase the depth of carbon diffusion.

Nitriding is a heat treating process that diffuses nitrogen into the surface of a metal to create a case hardened surface. These processes are most commonly used on low-carbon, low-alloy steels, however, they are also used on medium and high-carbon steels, titanium, aluminum, and molybdenum.

Boriding, also called boronizing, is the process by which boron is introduced to a metal or alloy. It is a type of surface hardening. In this process, boron atoms are diffused into the surface of a metal component.

Diffusion hardening is a process used in manufacturing that increases the hardness of steels. In diffusion hardening, diffusion occurs between a steel with a low carbon content and a carbon-rich environment to increase the carbon content of the steel and ultimately harden the workpiece.

In embodiments of the disclosure pertaining to non-visual inspection, the non-visual inspection can be one or more of the following techniques: magnetic particle inspection, magnetic flux leakage inspection, ultrasonic inspection, eddy current inspection, acoustic emission inspection, radiographic inspection, infrared thermography, and phased array ultrasonic testing.

In order to inspect the oilfield tools in a non-visual manner, methods of the invention can include passing used tools through one or more stationary inspection stations. Alternatively, one or more inspection apparatus can be moved along stationary tools. Alternatively, both the used tools and inspection apparatus can move.

In certain embodiments of the invention pertaining to non-visual inspection, magnetic flux leakage inspection is used. Such methods typically involve the use of a magnetic coil and a detector assembly for inspecting the rods. Such systems typically employ one or more magnetic detectors adapted to be spaced a first distance from the rod member by one or more substantially frictionless members during an inspection. Methods specifically pertaining to magnetic flux leakage inspection are found in U.S. Pat. No. 7,397,238, which is herein incorporated by reference in its entirety. Furthermore, the data from such tests can be presented in one or more formats, including visual format, such as on a CRT screen, flat panel screen, printer, strip chart recorder, and the like.

In embodiments of the invention pertaining to ultrasonic inspection, Ultrasonic testing (UT) is a family of non-destructive testing techniques based in the propagation of ultrasonic waves in the object or material tested. In most common UT applications, very short ultrasonic pulse-waves with center frequencies ranging from 0.1-15 MHz, and occasionally up to 50 MHz, are transmitted into materials to detect internal flaws or to characterize materials. A common example is ultrasonic thickness measurement, which tests the thickness of the test object, for example, to monitor pipework corrosion.

In embodiments pertaining to eddy current inspection, this method uses electromagnetic induction to detect flaws in conductive materials. There are several limitations, among them: only conductive materials can be tested, the surface of the material must be accessible, the finish of the material can cause bad readings, the depth of penetration into the material is limited by the materials' conductivity, and flaws that lie parallel to the probe can be undetectable.

In a standard eddy current inspection, a circular coil carrying current is placed in proximity to the test specimen (which must be electrically conductive). The alternating current in the coil generates changing magnetic field which interacts with test specimen and generates eddy current. Variations in the phase and magnitude of these eddy currents can be monitored using a second 'receiver' coil, or by measuring changes to the current flowing in the primary 'excitation' coil. Variations in the electrical conductivity or magnetic permeability of the test object, or the presence of any flaws, will cause a change in eddy current and a corresponding change in the phase and amplitude of the measured current. This is the basis of standard (flat coil) eddy current inspection, the most widely used eddy current technique.

However, eddy current testing can detect very small cracks in or near the surface of the material, the surfaces need minimal preparation, and physically complex geometries can be investigated. It is also useful for making electrical conductivity and coating thickness measurements.

In embodiments concerning acoustic emission inspection, this inspection is commonly defined as transient elastic waves within a material, caused by the release of localized stress energy. Hence, an event source is the phenomenon which releases elastic energy into the material, which then propagates as an elastic wave. Acoustic emissions can be detected in frequency ranges under 1 kHz, and have been reported at frequencies up to 100 MHz, but most of the released energy is within the 1 kHz to 1 MHz range. Rapid stress-releasing events generate a spectrum of stress waves starting at 0 Hz, and typically falling off at several MHz.

The major applications of acoustic emmission techniques are source location to determine the locations where an event source occurred; and material mechanical performance to evaluate and characterize materials/structures.

In embodiments concerning radiographic inspection, this is a nondestructive testing method of inspecting materials for hidden flaws by using the ability of short wavelength electromagnetic radiation to penetrate various materials.

Either an X-ray machine or a radioactive source, like Ir-192, Co-60, or in rarer cases Cs-137, is used in a X-ray computed tomography machine as a source of photons. Neutron radiographic testing (NR) is a variant of radiographic testing which uses neutrons instead of photons to penetrate materials. This can see very different things from X-rays, because neutrons can pass with ease through lead and steel but are stopped by plastics, water and oils.

Since the amount of radiation emerging from the opposite side of the material can be detected and measured, variations in this amount (or intensity) of radiation are used to determine thickness or composition of material. Penetrating radiations are those restricted to that part of the electromagnetic spectrum of wavelength less than about 10 nanometers.

Additionally, in addition to the detection of flaws, the oilfield tools, and in particular, rods, are separated into grades of steel. In such embodiments, it is beneficial to determine the grade of the steel rod before any treatment occurs so as to know the physical constraints and properties of the end product. In such embodiments, the grades of steel are typically divided into the following: Class C steel, Class D steel, Class KD steel, and High Strength steel. Within the classes, Class D steel is typically divided by alloy D and carbon D. This can be before the cleaning process or after the cleaning process or even after the inspection process.

Implementation

In implementation, rods are collected from petroleum producing sites and brought to a central location for inspection prior to any reconditioning processes. Visual inspection is typically the first step in the convention.

Typically, the process of visual inspection typically involves a person visually locating pitting, corrosion, wear, stretched rods and bent rods or other flaws in downhole tools. Any tool which fails to pass this visual inspection is removed from the aforementioned central location as rejected.

The tools, such as sucker rod tools, are either kept connected to couplings or have the couplings removed. Similarly, the downhole rod pumps are either kept assembled or disassembled into their component parts. The tools or their parts are typically laid on a rack that feeds into a transfer conveyor. The visibly damaged tools or components are typically removed immediately. The remaining tools or components are typically fed onto the conveyor which typically conveys the tools or components into an area designed to accommodate the cryogenic liquid cleaning. As the cryogenic liquid enters into the crevices, cracks, etc. of the debris and residue, the cryogenic liquid expands typically to between 100 and 1000 times its original size as it expands into a gas, thus removing the debris in the process.

The sucker rod is then generally ready to enter the remainder of the inspection process. The coupling is cleaned on the outside and inside diameters and is ready for the inspection process to commence.

Heating and Shaping

Certain embodiments of the invention include straightening of used sucker rods or making other tools or their components conform to specifications, and the tools are subjected to heating. In such embodiments, for example, a rod such as a sucker rod in need of reclamation is heated to a temperature favorable for plastic deformation of the rod. In the case of steel, the temperature is generally within the range of about 1500° F. to about 2500° F. This temperature range is known to be used for treating steel alloys through forging, rolling, deformation and the like. Still further in implementation, at the same time the rod is being heated to a temperature favorable for plastic deformation, a hot recrystallization of the rod takes place which eliminates inner stress of the rod that has accumulated during the course of the rod's operational life.

In certain embodiments the desired geometry of the used tools or components is obtained by treatment under pressure. In such embodiments, the cross sectional area of the tool, in this case, specifically a rod, can be varied while the standard length of the rod is maintained. In such embodiments, mechanical properties of rods can be enhanced during the pressure treatment such that a rod is structurally stronger in its peripheral zone. For example, by reheating the rod body up to a temperature which would allow it to undergo plastic deformation under pressure, the rod is structurally stronger in the peripheral zone as compared to rods treated by other methods of reclamation. Additionally, the high temperature used to make the rod favorable for plastic deformation also allows the rod to be reshaped to the correct geometric form as before without any defects caused in the operations such as cracks or cavities.

In further embodiments, reheating the tool is specifically achieved through the use of an induction furnace. As is known in the art, an induction furnace is an electrical furnace in which the heat is applied by induction heating of metal. The advantage of the induction furnace is a clean, energy-efficient and well-controllable melting process compared to most other means of metal melting. Since no arc or combustion is used, the temperature of the tool can be set such that it is no higher than what is required to make it amenable to plastic deformation; this can prevent loss of valuable alloying elements. Operating frequencies range from utility frequency (50 or 60 Hz) to 400 kHz or higher, usually depending on the material being melted, the capacity of the furnace, and the melting speed required. Generally, the smaller the volume of the melts, the higher the frequency of the furnace used; this is due to the skin depth which is a measure of the distance an alternating current can penetrate beneath the surface of a conductor. For the same conductivity, the higher frequencies have a shallow skin depth, in other words, that is less penetration into the melt. Lower frequencies can generate stifling or turbulence in the metal.

In still further embodiments, upon heating the used tool to a temperature favorable for plastic deformation, the used tool or its components can be treated under pressure, typically by radial-helical rolling. As a sucker rod or pump rod is an elongated bar shape, under pressure treatment the cross-sectional diameter of the rod will decrease such that the rod can be reformed into the next smaller standard size if desired. After plastic deformation, besides shrinking the cross-sectional area, the length of the rod will be increased if the mass of the metal remains constant or near constant. Typically, the reduction in diameter is one size down in terms of standard rod size. However, reduction by several sizes would allow two sucker rods to be produced out of one parent sucker rod. The standard sizes for sucker rods in English measurements are 1", ⅞", ¾", and ⅝".

As the heating and shaping increases the length, the tools, in the case of rods, can be cut before the heating and shaping to remove the ends, typically processed in one of two ways. In the first way, the rods simply have the ends cut off so that the rods are cut to the correct length and the remaining steel can be used to make pony rods. Alternatively, the ends can be cut off plus additional footage in the body of the rod in order to produce new bar stock that is the length needed to produce a new sucker rod.

After treatment via plastic deformation, the rods, such as sucker rods, can be raw bar stock that can be sold to users or other manufacturers in the petroleum industry. These rods can be made to a standardized length again by cold chiseling, abrasive cutting, or both.

In this embodiment, the users or other manufacturers can forge the ends of the sucker rods to fit their particular equipment needs.

Summary of Implementation

In implementation of the aforementioned embodiments and methods, and referring to FIG. 1, tools are collected from upstream petroleum producing sites via a collection process 1. Alternatively, the tools can be shipped to a common location via a shipment process 2. The tools, in particular, in the case of sucker rods are then subjected to pre-sortment 3. Sucker rods which have failed inspection are subject to a discarding process 4. Sucker rods which have not failed this inspection are subjected to a grade sortment procedure 5 to sort out the grade of steel, such as C 6, D 7, KD 8, and High Strength 9. Sucker rods which have not failed inspection due to extensive cracks or extensive corrosion and have been sorted, are then subjected to a cryogenic cleaning procedure 10.

In a preferred implementation, the sucker rods, separated by grade of steel, are taken to a plant. Each grade of sucker rods is treated in turn. In the plant, the sucker rods are first cleaned.

After cleaning, each sucker rod in need of straightening is subjected to hardening 11. After straightening, the rods are capable of being heated and shaped.

Optionally, in the case of sucker rods, each rod is placed upon a conveyor which transports each sucker rod through an induction furnace 12 or a series of induction furnaces with a temperature of between about 1500° F. to about 2500° F. The heating is designed not to melt the sucker rod but to soften each sucker rod to the point wherein plastic deformation is possible.

Following heating to the point wherein plastic deformation is possible, the sucker rod is subjected to a pressure machine 13 in order to smooth out any surface imperfections. This process compresses the sucker rod such that the cross sectional area can be changed.

Upon shaping, the conveyor removes the sucker rod from the pressure machine and the sucker rod is allowed to cool. After cooling, the sucker rod can then be optionally subjected to shot peening 14. Regardless of whether the sucker rod is subjected to shot peening, the sucker rod can be optionally cut to a desired length through a cutting procedure 15. When cut to a desired length, the sucker rod is then subjected to a non-visual inspection 16. Generally, the inspection process is eddy current inspection. After inspection, the sucker rod is shipped to an outside manufacturer 17 in order to forge end pieces on the sucker rod for appropriate applications. Optionally, factory forging 18 can be done wherein the forging is done at the same location as where the rod is heated and shaped.

It should be appreciated by those of skill in the art that the techniques disclosed in the aforementioned embodiments represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit or scope of the invention.

The invention claimed is:

1. A method of removing contaminants from a used oilfield tool, the method comprising the steps of:

a. obtaining a used oilfield tool contaminated with scale, asphaltenes or a combination thereof;

b. bombarding said contaminants with a substance comprising at least one cryogen, wherein the at least one cryogen is in solid or liquid form, and wherein the substance is propelled toward the used oilfield tool from at least one nozzle; and i. wherein the scale, asphaltenes or a combination thereof are removed from the used oilfield tool by:

1. kinetic energy from the at least one cryogen, wherein said kinetic energy accelerates the at least one cryogen such that said scale, asphaltenes or a combination thereof are blasted away from the used oilfield tool;

2. thermal shock that weakens the scale, asphaltenes or a combination thereof by dropping a temperature of the contaminants;

3. thermal-kinetic energy that causes vapor to form from sublimation of the at least one cryogen upon impact with said scale, asphaltenes or a combination thereof, wherein the vapor expands and causes micro explosions which remove the scale, asphaltenes or a combination thereof; or 4. combinations thereof;

c. hardening the oilfield tool to prevent growth of any cracks on an external surface of the oilfield tool;

d. subjecting the oilfield tool a to non-visual inspection.

2. The method of claim 1, wherein the at least one cryogen is selected from a group consisting of: liquid nitrogen, liquid oxygen, liquid hydrogen, liquid helium, liquid neon, liquid argon, liquid krypton liquid xenon, liquid sulfur hexafluoride, solid carbon dioxide or a combination thereof.

3. The method of claim 1, wherein the cryogen further comprises non-cryogenic solid particles.

4. The method of claim 1, wherein the hardening comprises hammering, shot blasting, shot peening, heat treating, heat treating and then quenching, tempering, induction hardening, case hardening, carburizing, nitriding, boriding, titanium carbon diffusion or a combination thereof.

5. The method of claim 1, wherein the oilfield tool is a downhole rod pump.

6. The method of claim 1, wherein the oilfield tool is a sucker rod coupling with an inner diameter.

7. The method of claim 1, wherein the oilfield tool is a sucker rod.

8. The method of claim 1, wherein the non-visual inspection is magnetic particle inspection, magnetic flux leakage inspection, ultrasonic inspection, eddy current inspection, acoustic emission inspection, radiographic inspection, acoustic emission, infrared thermography, phased array ultrasonic testing or a combination thereof.

9. The method of claim 5, further comprising disassembling the downhole rod pump prior to step b and assembling the downhole rod pump after step d.

10. The method of claim 6, further comprising measuring an inner diameter of the sucker rod coupling after step c or after step d.

11. The method of claim 9, wherein prior to assembling the downhole rod pump, the downhole rod pump is subjected to one or more outer diameter measurement, one or more inner diameter measurement or a combination thereof.

12. A method of washing oilfield tools contaminated with scale, asphaltenes or a combination thereof, wherein the method does not result in the release of volatile organic compounds into air, the method comprising:

a. obtaining a used oilfield tool with scale, asphaltenes or a combination thereof;

b. dipping the oilfield tool into a cryogenic solution, wherein the scale, asphaltenes or a combination thereof are removed by thermal shock that weakens the scale, asphaltenes or a combination thereof by dropping a temperature of the scale, asphaltenes or a combination thereof;

c. removing the oilfield tool from the cryogenic solution;

d. hardening the oilfield tool to prevent growth of any cracks on an external surface of the oilfield tool;

e. subjecting the oilfield tool to a non-visual inspection.

13. The method of claim 12, wherein the cryogenic solution comprises liquid nitrogen, liquid oxygen, liquid hydrogen, liquid helium, liquid neon, liquid argon, liquid krypton, liquid xenon, sulfur hexafluoride or a combination thereof.

14. The method of claim 12, wherein the hardening comprises hammering, shot blasting, shot peening, heat treating, heat treating and then quenching, tempering, induction hardening, case hardening, carburizing, nitriding, boriding, titanium carbon diffusion or a combination thereof.

15. The method of claim 12, wherein the oilfield tool is a downhole rod pump and the method further comprises disassembling the rod pump and measuring inner diameters of the pump.

16. The method of claim 12, wherein the oilfield tool is a sucker rod coupling and the method further comprises measuring an inner diameter of the sucker rod coupling.

17. The method of claim 12, wherein the oilfield tool is a sucker rod.

18. The method of claim 13, wherein the cryogenic solution further comprises a solid and the scale, asphaltenes or a combination thereof are removed by thermal shock, abrasion or a combination thereof.

19. The method of claim 18, wherein the solid in the cryogenic solution is solid carbon dioxide.

* * * * *